US006595178B2

(12) United States Patent
Araki

(10) Patent No.: US 6,595,178 B2
(45) Date of Patent: Jul. 22, 2003

(54) TWO-STROKE INTERNAL COMBUSTION ENGINE

(75) Inventor: Tsuneo Araki, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/977,789

(22) Filed: Oct. 15, 2001

(65) Prior Publication Data

US 2002/0043236 A1 Apr. 18, 2002

(30) Foreign Application Priority Data

Oct. 16, 2000 (JP) ..... 2000-315246

(51) Int. Cl.[7] ..... F02F 7/00

(52) U.S. Cl. ..... 123/195 R; 123/65 R; 123/41.65

(58) Field of Search ..... 123/195 R, 65 R, 123/41.65, 41.66

(56) References Cited

U.S. PATENT DOCUMENTS 5,195,480 A * 3/1993 Hudson ..... 123/195 R
5,950,578 A * 9/1999 Hirano et al. ..... 123/41.65
6,491,006 B2 * 12/2002 Jonsson et al. ..... 123/73 R

* cited by examiner

*Primary Examiner*—Tony M. Argenbright
*Assistant Examiner*—Katrina B. Harris
(74) *Attorney, Agent, or Firm*—Baker Botts LLP

(57) ABSTRACT

A two-stroke internal combustion engine is disclosed capable of reducing the number of pieces constituting the main body, thereby making it possible to reduce the number of parts such as assembling bolts and hence to reduce the manufacturing cost as well as the weight thereof while ensuring the rigidness of the main body. The main body of the engine includes a cylinder portion in which a piston is adapted to be fittingly inserted and a crankcase portion in which a crank shaft is rotatably supported via a bearing wherein the crankcase portion is constructed such that it is split into an upper and a lower crankcase portion by a horizontal plane which passes through a central axial line of the crankshaft, where the upper crankcase portion is integrated with the cylinder portion, thus forming an integral cylinder-case, and a fan case base is formed integral with the lower crankcase portion.

8 Claims, 3 Drawing Sheets

TWO-STROKE INTERNAL COMBUSTION ENGINE

BACKGROUND OF THE INVENTION

The present invention relates to a two-stroke internal combustion engine which is suited for use in a portable power working machine, and in particular to a two-stroke internal combustion engine which is capable of reducing the number of pieces constituting the main body which is essentially consisted of a cylinder portion and a crankcase portion, thereby making it possible to reduce the number of parts such as assembling bolts, etc. and hence to reduce the manufacturing cost as well as the weight thereof while ensuring the rigidness of the main body.

An ordinary two-stroke internal combustion engine which is conventionally used in a portable power working machine such as a bush cutter or a chain saw is generally provided with a main body essentially consisted of a cylinder portion in which a piston is slidably inserted, and a crankcase portion in which a crank shaft is rotatably supported via a bearing. In this case, the cylinder portion is formed separate from the crankcase portion, and the crankcase portion is formed of a vertical two-part (vertical split type) structure or a horizontal two-part (horizontal split type) structure. Further, a fan case for forced cooling fan for engine is usually attached to the crankcase portion or to the cylinder portion.

As described above, according to the conventional two-stroke internal combustion engine, the main body thereof is constituted by three or four pieces, and the fan case is required to be subsequently attached to the crankcase portion or to the cylinder portion by making use of bolts, etc. As a result, a large number of assembling bolts are required for assembling the main body, and the working and assembling of the main body is troublesome, thus making it difficult to reduce the weight and manufacturing cost of the main body.

The present invention has been made to overcome the aforementioned problems accompanied with the conventional two-stroke internal combustion engine, and therefore, an object of the present invention is to provide a two-stroke internal combustion engine which is capable of reducing the number of pieces constituting the main body, thereby making it possible to reduce the number of parts such as assembling bolts, etc. and hence to reduce the manufacturing cost as well as the weight thereof while ensuring the rigidness of the main body.

BRIEF SUMMARY OF THE INVENTION

With a view to realize the aforementioned objects, the two-stroke internal combustion engine according to the present invention fundamentally comprises a main body essentially consisting of a cylinder portion in which a piston is adapted to be fittingly inserted; a crankcase portion in which a crank shaft is rotatably supported via a bearing.

The crankcase portion is featured in that it is split into an upper crankcase portion and a lower crankcase portion by a horizontal plane which passes through the central axial line of the crankshaft, wherein the upper crankcase portion is integrated with the cylinder portion, thus forming an integral cylinder-case, and a fan case base is formed integral with the lower crankcase portion.

In a preferred embodiment of the present invention, the fan case base is integrally provided with a reinforcing bridge portion overhanging the crankshaft, both end portions of the reinforcing bridge portion being designed to be fastened by means of bolts, etc. to the cylinder-case.

On the occasion of assembling the two-stroke internal combustion engine of the present invention which is constructed as described above, the crankshaft and the bearing are interposed between the upper crankcase portion of the cylinder-case and the lower crankcase portion, and at the same time, one end portion of the crankshaft is disposed below the reinforcing bridge portion of the fan case base. Then, the cylinder-case is fastened to the lower crankcase portion by means of bolts, etc. and at the same time, the both end portions of the reinforcing bridge portion are fixed to the cylinder-case by means of bolts, etc.

According to the two-stroke internal combustion engine of the present invention as described above, the main body inclusive of the fan case base is constituted by only two pieces, and the fan case base which is integrally provided with the reinforcing bridge portion is designed to be fastened to the cylinder-case by means of bolts, etc. As a result, the number of parts such as assembling bolt, etc. can be reduced, and hence the working and assembling of the main body can be facilitated, thus making it possible to reduce the manufacturing cost as well as the weight thereof while ensuring the rigidness of the main body.

DETAILED DESCRIPTION OF THE INVENTION

Next, one embodiment of the two-stroke internal combustion engine according to the present invention will be further explained with reference to the drawings.

Figure 1:
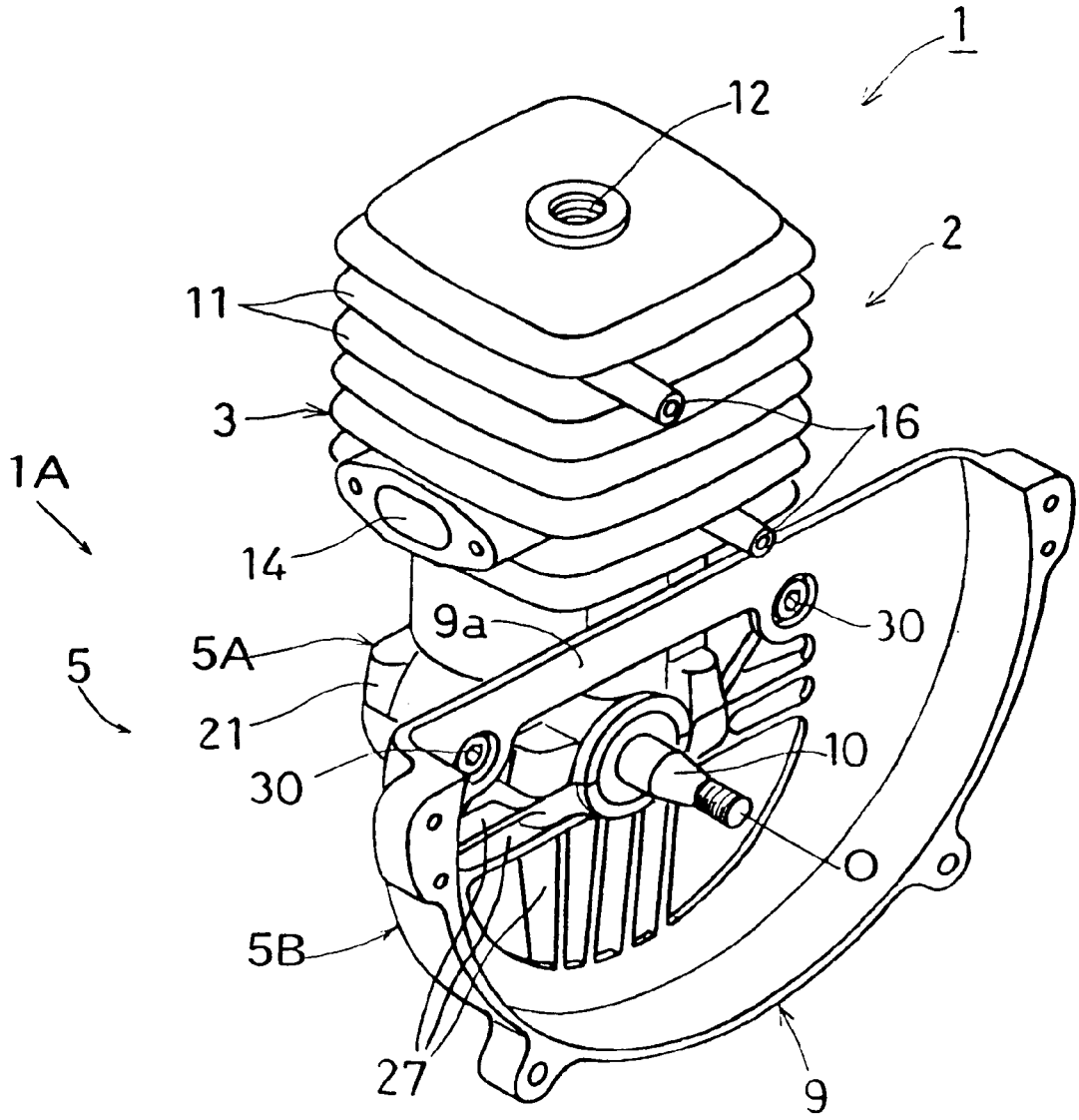
FIG. 1 is a perspective view illustrating the assembled state of a two-stroke internal combustion engine according to one embodiment of the present invention.
Figure 2:
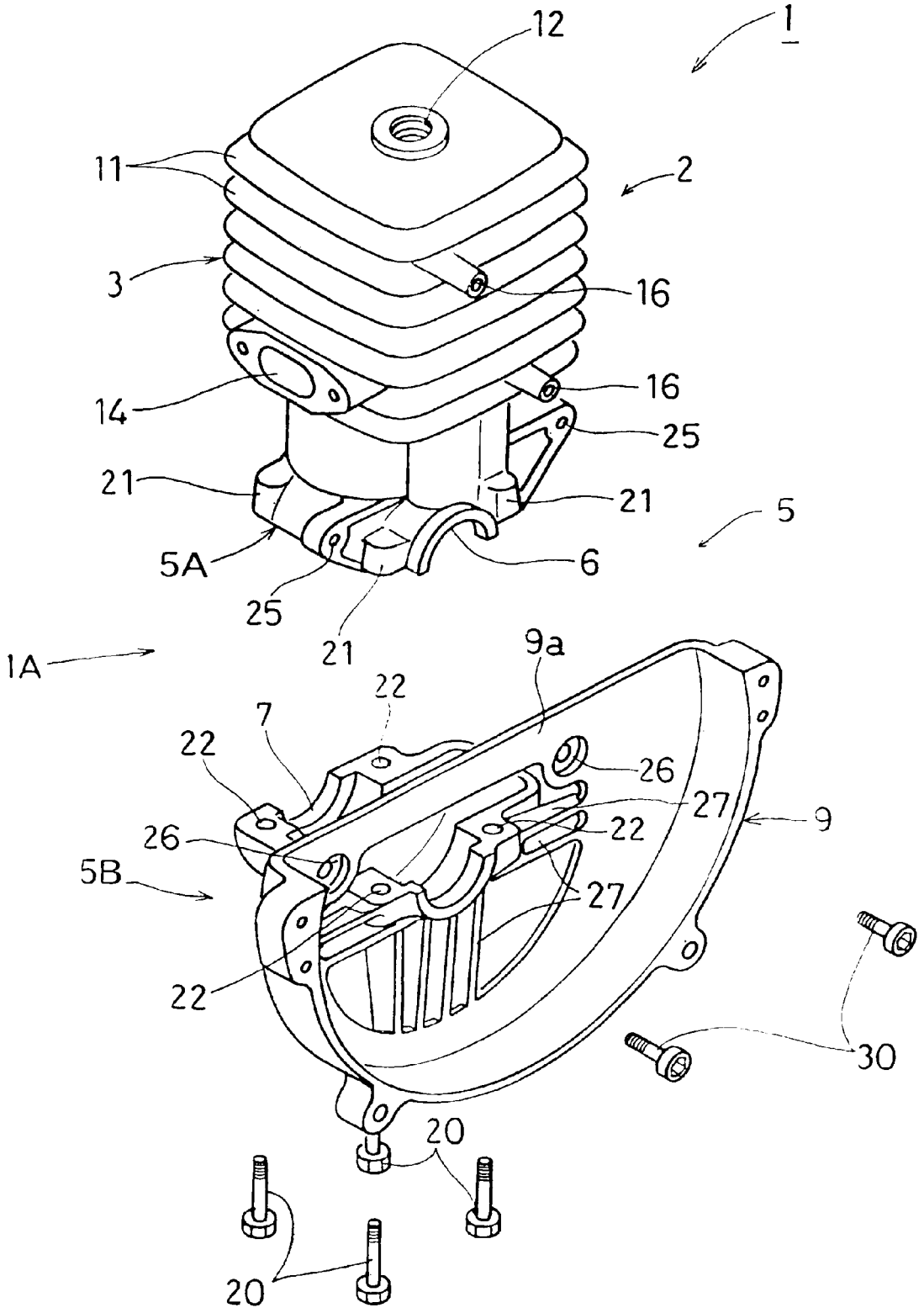
FIG. 2 is an exploded perspective view of the main portion of the engine shown in FIG. 1.
Figure 3:
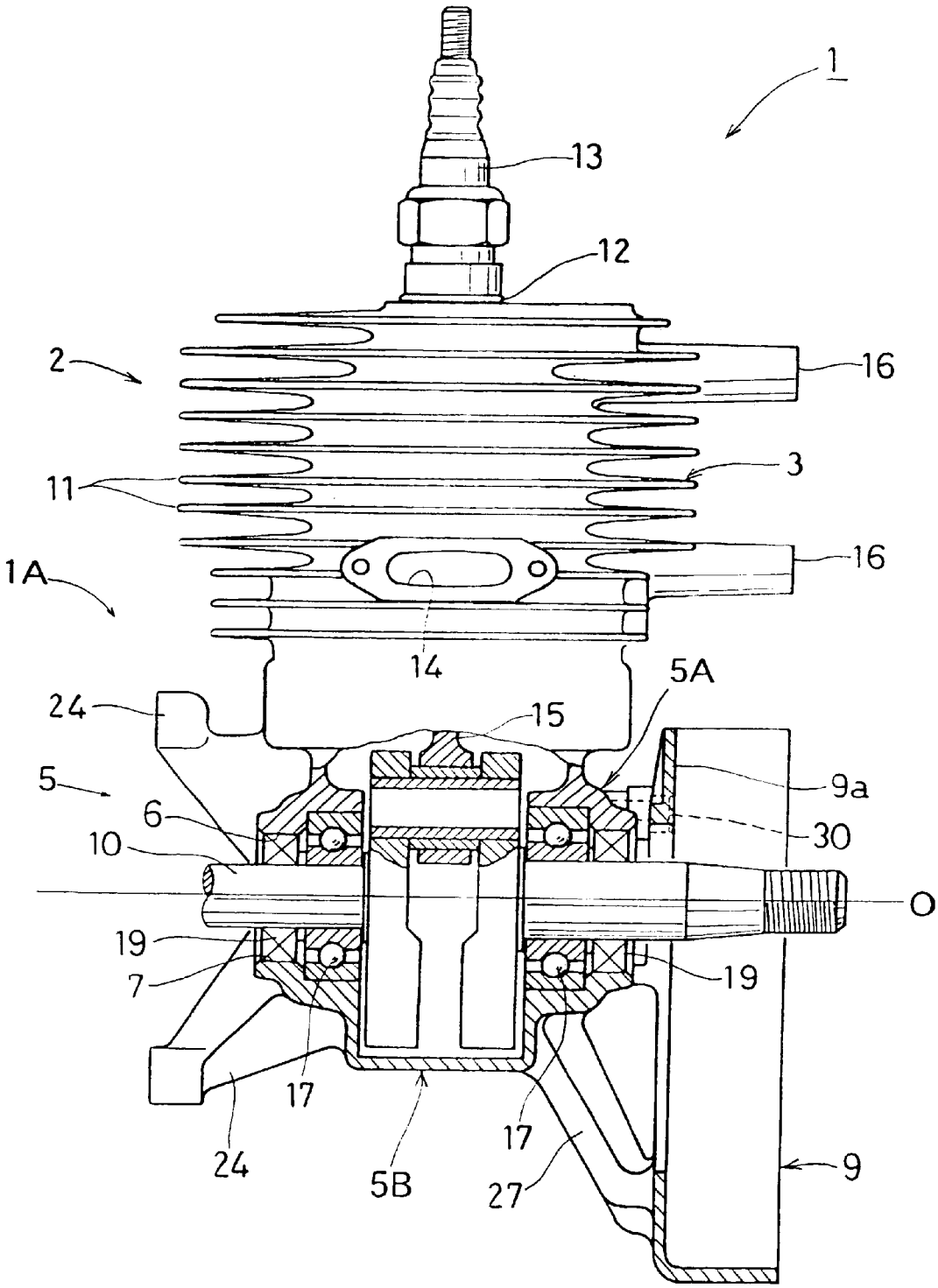
FIG. 3 is partially cut side view of the engine shown in FIG. 1.

FIG. 1 shows a perspective view illustrating the assembled state of a two-stroke internal combustion engine according to one embodiment of the present invention; FIG. 2 is an exploded perspective view of the main portion of the engine shown in FIG. 1; and FIG. 3 is partially cut side view of the engine shown in FIG. 1.

Referring to these FIGS., the two-stroke internal combustion engine 1 is provided with a main body portion 1A made of an aluminum alloy diecast and comprising a cylinder portion 3 in which a piston (not shown) is fittingly inserted, and a crankcase portion 5 rotatably supporting a crankshaft 10 via a pair of right and left bearings 17 and a pair of oil seals 19. The piston is designed to be moved up and down by the crankshaft 10 through a connecting rod 15.

The crankcase portion 5 is constructed such that it is split into an upper crankcase portion 5A and a lower crankcase portion 5B by a horizontal plane which passes through a central axial line O of the crankshaft 10, wherein the upper crankcase portion 5A is integrated with the cylinder portion 3, thus forming an integral cylinder-case 2, and a fan case base 9 constituting the base portion of the forced cooling fan for engine is formed integral with the lower crankcase portion 5B.

The cylinder portion 3 is provided, on the outer circumferential wall thereof, with a large number of cooling fins 11, and, at the head portion thereof, with a mounting hole 12 for mounting an ignition plug 13. Further, the cylinder portion 3 is provided, as in the case of the ordinary two-stroke internal combustion engine, with an exhaust port 14, scavenging passageway (not shown), bosses 16 for mounting magneto coil, etc.

The upper crankcase portion 5A and the lower crankcase portion 5B are provided with semi-circular stepped mounting portions 6 and 7, respectively, whereby the bearings 17 and the oil seals 19 are enabled to be held between the upper crankcase portion 5A and the lower crankcase portion 5B. Further, as shown in FIG. 3, the upper crankcase portion 5A and the lower crankcase portion 5B are provided with four recoil starter-mounting portions 24, forming an X-shaped front view and projected therefrom. Further, the lower crankcase portion 5B is integrally provided with a fan case reinforcing support portions 27.

Additionally, at an upper portion of the fan case base 9, there is integrally formed a reinforcing bridge portion 9*a* which is extended right and left so as to overhang one end portion of the crankshaft 10. This reinforcing bridge portion 9*a* is provided, at both end portions thereof, with bolt-inserting holes 26 for enabling a couple of bolts 30 to be inserted therein to thereby fasten the fan case base 9 to the cylinder-case 2.

The lower crankcase portion 5B is provided, at four corners thereof (i.e. the fore right and left portions and the rear right and left portions thereof), with bolt-inserting holes 22 for enabling four through-bolts 20 to be introduced therein from underside thereof for enabling the lower crankcase portion 5B to be fastened to the cylinder-case 2.

The upper crankcase portion 5A of the cylinder-case 2 is also provided, at four corners thereof (i.e. the fore right and left portions and the rear right and left portions thereof), with internal thread portions 21 for enabling the four through-bolts 20 to be screwed therein, and, at one sidewall thereof, with a couple of internal thread portions 25 for enabling the couple of bolts 30 to be screwed therein.

On the occasion of assembling the two-stroke internal combustion engine 1 of this embodiment which is constructed as described above, the crankshaft 10, the bearings 17 and the oil seals 19 are interposed between the upper crankcase portion 5A of the cylinder-case 2 and the lower crankcase portion 5B, and at the same time, one end portion of the crankshaft 10 is disposed below the reinforcing bridge portion 9*a* of the fan case base 9. Then, the cylinder-case 2 and the lower crankcase portion 5B are aligned face to face with each other, and the four through-bolts 20 are inserted from the underside of the lower crankcase portion SB into the bolt-inserting holes 22 and screwed into the internal thread portions 21 to thereby fasten the cylinder-case 2 to the lower crankcase portion 5B. Additionally, the couple of bolts 30 are screwed, through the bolt-inserting holes 26 formed at both end portions of the reinforcing bridge portion 9*a*, into the internal thread portions 25 of the upper crankcase portion 5A, respectively, to thereby fasten the fan case base 9 to the cylinder-case 2.

According to the two-stroke internal combustion engine 1 of the present invention as described above, the main body 1A inclusive of the fan case base 9 is constituted by only two pieces, and the fan case base 9 which is integrally provided with the reinforcing bridge portion 9*a* is designed to be fastened to the cylinder-case 2 by means of bolts 30, etc. As a result, the number of parts such as assembling bolt, etc. can be reduced, and hence the working and assembling of the main body can be facilitated, thus making it possible to reduce the manufacturing cost as well as the weight thereof while ensuring the rigidness of the main body.

As clear from the above explanation, according to the present invention, the main body inclusive of the fan case base is constituted by only two pieces, and the fan case base which is integrally provided with the reinforcing bridge portion is designed to be fastened to the cylinder-case by means of bolts, etc. As a result, the number of parts such as assembling bolt, etc. can be reduced, and hence the working and assembling of the main body can be facilitated, thus making it possible to reduce the manufacturing cost as well as the weight thereof while ensuring the rigidness of the main body.

What is claimed is:

1. A two-stroke internal combustion engine comprising a main body essentially consisting of a cylinder portion in which a piston is adapted to be fittingly inserted; and a crankcase portion in which a crank shaft is rotatably supported via a bearing; wherein said crankcase portion is constructed such that it is split into an upper crankcase portion and a lower crankcase portion by a horizontal plane which passes through a central axial line of the crankshaft, where the upper crankcase portion is integrated with the cylinder portion, thus forming an integral cylinder-case, and a fan case base is formed integral with the lower crankcase portion.

2. A two-stroke internal combustion engine comprising a main body consisting essentially of a cylinder portion in which a piston is adapted to be fittingly inserted; and a crankcase portion in which a crank shaft is rotatably supported via a bearing; wherein said crankcase portion is constructed such that it is split into an upper crankcase portion and a lower crankcase portion by a horizontal plane which passes through a central axial line of the crankshaft, where the upper crankcase portion is integrated with the cylinder portion, thus forming an integral cylinder-case, and a fan case base is formed integral with the lower crankcase portion, wherein said fan case base is integrally provided with a reinforcing bridge portion overhanging the crankshaft, both end portions of the reinforcing bridge portion being designed to be fastened by means of bolts to the cylinder-case.

3. A two-stroke internal combustion engine comprising a main body essentially consisting of a cylinder portion in which a piston is adapted to be fittingly inserted; and a crankcase portion in which a crank shaft is rotatably supported via a bearing; wherein said crankcase portion is constructed such that it is split into an upper crankcase portion and a lower crankcase portion by a horizontal plane which passes through a central axial line of the crankshaft, where the upper crankcase portion is integrated with the cylinder portion, thus forming an integral cylinder-case, and a fan case base having an upper portion overhanging one end portion of the crankshaft is formed integral with the lower crankcase portion.

4. The two-stroke internal combustion engine according to claim 3, wherein said fan case base is integrally provided with a reinforcing bridge portion overhanging the crankshaft, both end portions of the reinforcing bridge portion being designed to be fastened by means of bolts to the cylinder-case.

5. A two-stroke internal combustion engine comprising a main body comprising a cylinder portion in which a piston is adapted to be fittingly inserted; and a crankcase portion in which a crank shaft is rotatably supported via a bearing; wherein said crankcase portion is constructed such that it is split into an upper crankcase portion and a lower crankcase portion by a horizontal plane which passes through a central axial line of the crankshaft, where the upper crankcase portion is integrated with the cylinder portion, thus forming an integral cylinder-case, and a fan case base is formed integral with the lower crankcase portion.

6. A two-stroke internal combustion engine comprising a main body comprising a cylinder portion in which a piston is adapted to be fittingly inserted; and a crankcase portion in which a crank shaft is rotatably supported via a bearing; wherein said crankcase portion is constructed such that it is split into an upper crankcase portion and a lower crankcase portion by a horizontal plane which passes through a central axial line of the crankshaft, where the upper crankcase portion is integrated with the cylinder portion, thus forming an integral cylinder-case, and a fan case base is formed integral with the lower crankcase portion, wherein said fan case base is integrally provided with a reinforcing bridge portion overhanging the crankshaft, both end portions of the reinforcing bridge portion being designed to be fastened by means of bolts to the cylinder-case.

7. A two-stroke internal combustion engine comprising a main body comprising a cylinder portion in which a piston is adapted to be fittingly inserted; and a crankcase portion in which a crank shaft is rotatably supported via a bearing; wherein said crankcase portion is constructed such that it is split into an upper crankcase portion and a lower crankcase portion by a horizontal plane which passes through a central axial line of the crankshaft, where the upper crankcase portion is integrated with the cylinder portion, thus forming an integral cylinder-case, and a fan case base is formed integral with the lower crankcase portion, wherein said fan case base includes an upper portion overhanging one end portion of the crankshaft.

8. The two-stroke internal combustion engine according to claim 7, wherein said fan case base is integrally provided with a reinforcing bridge portion overhanging the crankshaft, both end portions of the reinforcing bridge portion being designed to be fastened by means of bolts to the cylinder-case.

* * * * *